US005428338A

United States Patent [19]

Nixon et al.

[11] Patent Number: 5,428,338

[45] Date of Patent: Jun. 27, 1995

[54] THERMAL CUTOFF ASSEMBLY

[75] Inventors: Ronald A. Nixon, Mansfield, Ohio; Harry M. Crease; Lewis W. Smith, both of London, Ky.

[73] Assignee: Therm-O-Disc, Incorporated, Mansfield, Ohio

[21] Appl. No.: 179,231

[22] Filed: Jan. 10, 1994

[51] Int. Cl.[6] ..... H01H 37/76

[52] U.S. Cl. ..... 337/414; 337/407

[58] Field of Search ..... 337/401, 407, 414, 417

[56] References Cited

U.S. PATENT DOCUMENTS 3,820,050 6/1974 Tyler et al. ..... 337/414

4,451,814 5/1984 Barry et al. ..... 337/407

*Primary Examiner*—Lincoln Donovan

*Attorney, Agent, or Firm*—Jones, Day, Reavis & Pogue

[57] ABSTRACT

A thermal cutoff encapsulated in potting material within a dielectric tubular housing having an oval cross-sectional shape and a flat closed end. The thermal cutoff has a cylindrical body located intermediate the open and closed ends of the tubular housing, and the longitudinal axis of the thermal cutoff body is parallel to and laterally offset from the longitudinal axis of the tubular housing.

23 Claims, 1 Drawing Sheet

THERMAL CUTOFF ASSEMBLY

BACKGROUND OF THE INVENTION

This application relates to the art of thermal cutoffs and, more particularly, to thermal cutoff assemblies that include a thermal cutoff combined with a housing used to position the thermal cutoff in a working environment. The invention is particularly applicable for use with icemakers and will be described with specific reference thereto. However, it will be appreciated that the invention has broader aspects and can be used in other environments.

Icemakers commonly include a heater element for partially thawing ice cubes to facilitate ejection of same from the receptacle in which they are frozen. In the event of a malfunction, the heater element may go into thermal runaway and cause a fire. Safety requirements specify thermal upper limit backup protection for preventing such thermal runaway. It would be desirable to have a thermal cutoff assembly that is shaped and constructed for ease of assembly and ease of mounting to an icemaker while providing the desirable sensitivity to temperature changes.

SUMMARY OF THE INVENTION

A thermal cutoff assembly of the type described includes a dielectric tubular housing having a closed distal end and an open proximate end. In a preferred arrangement, the tubular housing has an oval cross-sectional shape and a flat closed end. A peripheral flange extends outwardly from the tubular housing at the open end thereof.

A thermal cutoff is positioned within the tubular housing intermediate its closed and open ends. The thermal cutoff includes a cylindrical body having a longitudinal axis and is positioned with such axis extending parallel to the longitudinal axis of the tubular housing. The longitudinal axis of the cylindrical body is also laterally offset from the longitudinal axis of the tubular housing.

A pair of opposite leads are provided at opposite ends of the thermal cutoff. The thermal cutoff is positioned with one of its leads facing toward the closed end of the tubular housing and with its other lead facing toward the open end of the tubular housing. Insulated wires extend into the tubular housing and have stripped bare ends welded to the leads on the thermal cutoff.

A potting material fills a sufficient length of the tubular housing from its closed end toward its open end to encapsulate the thermal cutoff and the connections between the wire leads and the thermal cutoff leads.

It is a principal object of the present invention to provide an improved thermal cutoff assembly.

It is also an object of the invention to provide an improved thermal cutoff assembly for use in preventing thermal runaway of a heater in icemakers.

It is an additional an object of the invention to provide a thermal cutoff assembly that is simple to manufacture and assemble.

It is a further object of the invention to provide a thermal cutoff assembly that is very easy to mount in a working position in an icemaker.

It is another object of the invention to provide a thermal cutoff assembly having optimum sensitivity to temperature changes within an icemaker.

DESCRIPTION OF A PREFERRED EMBODIMENT

Figure 1:
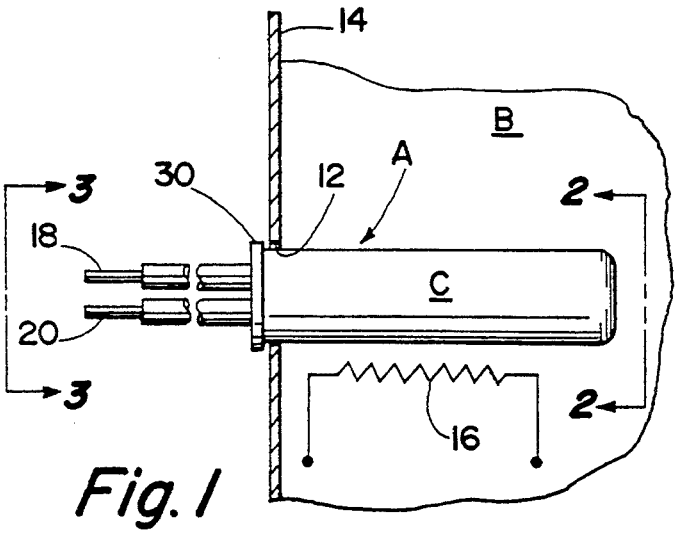
FIG. 1 is a side elevational view of a thermal cutoff assembly constructed in accordance with the present application inserted into an icemaker chamber through an opening in a wall.
Figure 2:
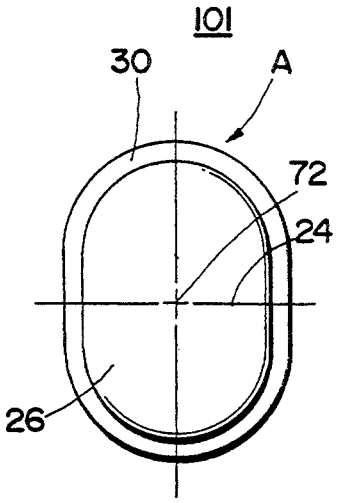
FIG. 2 is an end elevational view taken generally on line 2—2 of FIG. 1.

Referring now the drawing, wherein the showings are for purposes of illustrating a preferred embodiment of the invention only and not for purposes of limiting same, FIG. 1 shows a thermal cutoff assembly A projecting into an icemaker chamber or compartment B through an opening 12 in wall 14. Thermal cutoff assembly A is positioned in proximity to an electric heater 16 used to partially thaw ice cubes for ejection from the receptacle in which they are frozen. Thermal cutoff assembly A includes a thermal cutoff having wire leads 18, 20 for connecting the thermal cutoff in series with heater 16. In the event a malfunction occurs, heat from heater element 16 will liquify a thermal pellet in the thermal cutoff within assembly A for deenergizing heater 16.

Thermal cutoff assembly A includes an elongated tubular housing C of suitable dielectric material such as synthetic plastic. Tubular housing C has a substantially oval cross-sectional shape with a major axis 22 that is at least 25% longer than its minor axis 24. In the arrangement shown, major axis 22 is approximately 35% larger than minor axis 24. The wall thickness of tubular housing C is substantially uniform so that the interior and exterior shapes of housing C are geometrically similar. Tubular housing C has a substantially flat closed distal end 26 and an open proximate end 28 with an outwardly extending peripheral flange 30 therearound.

With reference to FIG. 1, opening 12 in wall 14 has an oval cross-sectional shape the same as tubular housing C and is slightly larger in size to facilitate insertion of housing C through opening 12 until flange 30 abuts the outside surface of wall 14. Epoxy or another suitable adhesive sealant may be positioned around the horizontally facing surface of flange 30 for securing same to the exterior surface of wall 14 surrounding opening 12. This securely mounts thermal cutoff assembly A in a working position.

It will be recognized that the thermal cutoff used in the assembly of the present application may take many forms. One preferred form of thermal cutoff will be described briefly with respect to FIG. 5. Thermal cutoff D is in the form of a substantially cylindrical body that includes an electrically conductive generally cup-shaped metal housing 40 having an electrical lead 42 attached to one end 44 thereof.

A solid fusible pellet 46 positioned within housing 40 is adapted to liquify when a predetermined temperature is exceeded. Pellet 46 may be an organic chemical, two examples of which are caffeine and animal protein.

A coil spring 48 is compressed between a disk 50 and a slidable star contact 52. Star contact 52 has a plurality of circumferentially-spaced outwardly inclined resilient fingers that resiliently engage the interior of housing 40 in electrically conductive sliding relationship therewith.

A ceramic bushing 54 is retained within housing 40 by crimping housing end portion 56 inwardly. An electrical lead 58 mounted in bushing 54 has a contact 60 thereon for cooperation with star contact 52. Bushing 54 and a portion of lead 58 are covered by epoxy sealant 62. A coil spring 64 is compressed between bushing 54 and star contact 52 around lead contact 60.

Figure 5:
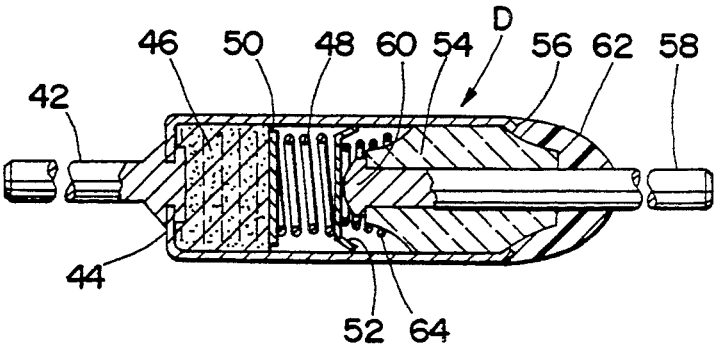
FIG. 5 is a cross-sectional elevational view of a typical thermal cutoff used in the assembly of FIGS. 1–4.

With the thermal cutoff arrangement shown and described with respect to FIG. 5, there is a conductive path from lead 42 to lead 58 through housing 40 to star contact 52 and then to lead contact 60. When thermal pellet 46 liquifies, coil spring 48 expands as disk 50 moves toward end 44 of housing 40. The biasing force of spring 64 then becomes greater than the biasing force of spring 48 for moving star contact 52 to the left in FIG. 5 away from lead contact 60. Once star contact 52 separates from lead contact 60, there is no longer a complete electrical path from lead 42 to lead 58.

Thermal cutoff D is positioned in tubular housing C with its longitudinal axis 70 extending substantially parallel to and laterally offset from the longitudinal axis 72 of tubular housing C. The cylindrical body of thermal cutoff D is located in tubular housing C intermediate closed and open ends 26, 28 thereof. In the arrangement shown, shadow line 74 represents the midpoint of the distance between the inside bottom surface of tubular housing C and the exterior of open end 28 thereof. As shown, the cylindrical body of thermal cutoff D extends on both sides of midpoint 74 but a major length of thermal cutoff D is located toward closed end 26.

Thermal cutoff assembly D is positioned with one of its leads 58 facing toward closed end 26 of tubular housing C and with its opposite lead 42 facing toward open end 28 of tubular housing C. Wire leads 18, 20 have the insulation stripped therefrom to provide bare wire end portions 78, 80 that are welded to thermal cutoff leads 58, 42.

Figure 4:
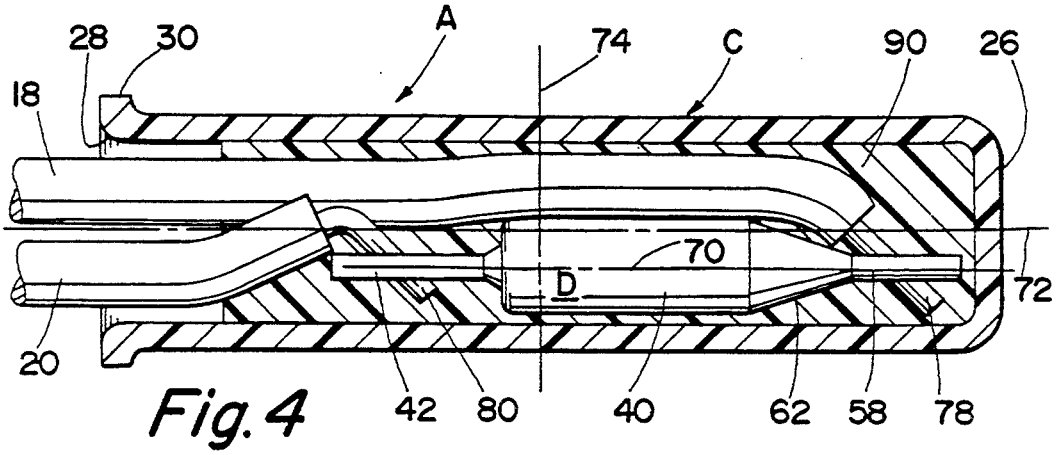
FIG. 4 is a cross-sectional elevational view taken generally on line 4—4 of FIG. 3.
Figure 3:
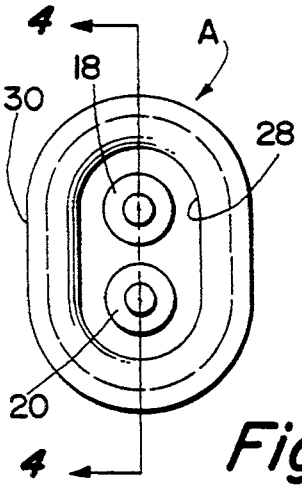
FIG. 3 an opposite end elevational view taken generally on line 3—3 of FIG. 1.

To assemble the entire thermal cutoff package, wire leads 18, 20 are first welded to the leads on thermal cutoff D to provide a thermal cutoff and wire lead assembly. A sufficient amount of epoxy or other potting material 90 is then placed within tubular housing C to complete encapsulate the thermal cutoff and its connections. The thermal cutoff and wire lead assembly is then inserted into tubular housing C through the still liquid epoxy or other potting material. The epoxy or potting material is then allowed to solidify to form the completed assembly shown in FIG. 4. Tubular housing C need not be completely filled with the potting material. Sufficient potting material is provided to completely fill a sufficient length of tubular housing C from closed end 26 thereof toward open end 28 thereof to completely encapsulate the thermal cutoff and the connections thereto with wire leads 18, 20. One wire lead 18 extends completely past thermal cutoff D within tubular housing C as shown in FIG. 4.

The potting material 90 is preferably one having a good thermal conductivity such as an epoxy filled with ceramic powder to provide good transfer of heat to thermal cutoff D.

Although the invention has been shown and described with respect to a preferred embodiment, it is obvious that equivalent alterations and modifications will occur to others skilled in the art upon the reading and understanding of this specification. The present invention includes all such equivalent alterations and modifications, and is limited only by the scope of claims.

We claim:

1. A thermal cutoff assembly comprising a dielectric tubular housing having a distal end and an open proximate end, a thermal cutoff self-contained in a metal housing independent of said tubular housing and being positioned in said tubular housing intermediate said ends, a pair of lead wires connected with said thermal cutoff and extending through said open end, and a heat transfer material filling a sufficient portion of said housing from said distal end thereof toward said open end thereof to encapsulate said thermal cutoff metal housing therein, said transfer material being in heat transfer contact with said metal housing.

2. The assembly of claim 1 wherein said housing has a substantially oval cross-sectional shape.

3. The assembly of claim 2 wherein said substantially oval cross-sectional shape includes major and minor axes and said major axis is at least 25% larger than said minor axis.

4. The assembly of claim 1 wherein said distal end is closed and substantially flat.

5. The assembly of claim 1 including a peripheral flange extending outwardly from said housing at said open end thereof.

6. The assembly of claim 1 wherein said thermal cutoff has a pair of opposite leads and is positioned with one of said leads facing said distal end of said housing and with the other of said leads facing said open end of said housing.

7. The assembly of claim 6 wherein one of said lead wires extends past said thermal cutoff within said housing to connection with said one lead on said thermal cutoff.

8. The assembly of claim 1 wherein said thermal cutoff includes a cylindrical body having a longitudinal axis and is positioned in said housing with said longitudinal axis extending longitudinally of said housing.

9. The assembly of claim 8 wherein said housing has a housing longitudinal axis and said thermal cutoff body is positioned with its longitudinal axis laterally offset from said housing longitudinal axis.

10. A thermal cutoff assembly comprising a tubular housing of dielectric material having a distal end and an open proximate end, a self-contained thermal cutoff independent of said tubular housing and being positioned in said housing, said tubular housing being filled with potting material to a level sufficient to encapsulate said thermal cutoff in heat transfer relationship, and said housing having a substantially oval cross-sectional shape.

11. The assembly of claim 10 wherein said thermal cutoff includes a cylindrical body positioned in said housing laterally offset from the longitudinal center of said housing.

12. The assembly of claim 10 wherein said housing has a midpoint half way between said distal and open ends and said thermal cutoff is positioned in said housing to extend on both sides of said midpoint.

13. The assembly of claim 10 including an icemaker compartment on one side of a wall having an opening therethrough, an electric heater in said compartment adjacent said opening, and said thermal cutoff assembly projecting into said compartment through said wall opening in proximity to said heater.

14. In an icemaker compartment including a wall having an opening therein for providing access to said compartment, an electric heater in said compartment adjacent said opening, and a thermal cutoff assembly extending through said opening into said compartment in proximity to said heater.

15. The device of claim 14 wherein said thermal cutoff assembly includes a dielectric tubular housing and said opening has a predetermined size and shape, said tubular housing having approximately the same size and shape as said opening.

16. The device of claim 14 wherein said opening is non-circular.

17. The device of claim 14 wherein said thermal cutoff assembly includes a dielectric tubular housing having an open end, and outwardly extending flange on said tubular housing adjacent said open end on the opposite side of said wall from said compartment.

18. The device of claim 14 wherein said thermal cutoff assembly comprises a self-contained thermal cutoff having a metal housing received within an elongated dielectric tubular housing.

19. The device of claim 14 wherein said thermal cutoff is potted in said tubular housing, said tubular housing having an open end located on the opposite side of said wall from said compartment, and said thermal cutoff having electrical leads extending through said open end.

20. A thermal cutoff assembly comprising an elongated dielectric tubular housing having an open end, a self-contained thermal cutoff received in said tubular housing through said open end thereof, and potting material within said tubular housing encapsulating said thermal cutoff in heat transfer relationship therewith.

21. The assembly of claim 20 wherein said thermal cutoff has a pair of electrical wire leads extending through said open end of said tubular housing.

22. The assembly of claim 20 including an outwardly extending flange on said tubular housing adjacent said open end thereof.

23. The assembly of claim 20 wherein said tubular housing has a non-cylindrical cross-sectional shape & said thermal cutoff includes a substantially cylindrical metal housing.

* * * * *